United States Patent [19]

Dutcher et al.

[11] 4,138,012

[45] Feb. 6, 1979

[54] CARTON FOR HOLDING AND DISPLAYING A STACKED ARRAY OF FLAT RECTANGULAR BOXES

[75] Inventors: Daniel P. Dutcher, Woodbury; Robert A. Bliss, St. Paul, both of Minn.

[73] Assignee: Champion International Corporation, Stamford, Conn.

[21] Appl. No.: 870,739

[22] Filed: Jan. 19, 1978

[51] Int. Cl.[2] ..... B65D 5/54

[52] U.S. Cl. ..... 206/45.19; 248/174; 229/41 B

[58] Field of Search ..... 229/41 B; 206/45.14, 206/45.19, 44 D; 248/174

[56] References Cited

U.S. PATENT DOCUMENTS

| | | | |
|---|---|---|---|
| 1,501,016 | 7/1924 | Young | 204/45.19 |
| 1,764,216 | 6/1930 | Laubenheimer | 206/45.19 X |
| 2,132,604 | 10/1938 | Chase | 206/45.19 |
| 2,146,421 | 2/1939 | Davidson | 206/45.19 UX |
| 2,197,506 | 4/1940 | Moss | 206/45.19 X |
| 2,300,411 | 11/1942 | Dubey | 206/45.14 |
| 2,430,166 | 11/1947 | Fish et al. | 248/174 UX |
| 2,571,301 | 10/1951 | Slanhoff | 248/174 X |
| 3,494,536 | 2/1970 | Henry | 229/41 B X |
| 3,987,893 | 10/1976 | Hansom | 206/45.14 |

*Primary Examiner*—Davis T. Moorhead
*Attorney, Agent, or Firm*—Evelyn M. Sommer

[57] ABSTRACT

A one-piece paperboard blank for erecting into a carton for holding and displaying a stacked array of generally flat rectangular boxes includes generally right triangular-shaped sides, a back, a base, and a partially open top portion into which the rectangular boxes are received. The carton includes an inclined support panel disposed wholly within the carton and extending from the top of the back panel to a point intermediate the bottom panel. Cushion flaps are provided inside of the carton contiguous with the opposite sides thereof, whereby the stack of rectangular boxes are disposed at an inclined angle within the carton, and are resiliently gripped by the opposed cushion flaps. The forwardmost portion of the top of the carton is closed by a panel containing indicia.

6 Claims, 3 Drawing Figures

CARTON FOR HOLDING AND DISPLAYING A STACKED ARRAY OF FLAT RECTANGULAR BOXES

The subject invention relates to a new and improved carton for accommodating generally flat, rectangular boxes, such as packages for cosmetics, drugs, and the like, where it is desired to maintain the packages in stacked array at an inclined angle. By this arrangement, most of the rectangular package is readily visible which is desirable for marketing purposes, and in addition, the resulting arrangement of the packages is aesthetically pleasing. It is also an object of the invention to provide a carton wherein the edges defining the opening into which the stacked array of boxes is placed are formed by folded over paperboard material thereby further enhancing the aesthetics of the carton. It is another object of the invention to provide a carton for holding a stacked array of flat rectangular boxes at an inclined angle, and yet provide a portion of the front panel of the carton with an area for indicia or advertising material. It is another object of the subject invention to provide a carton which is made of a one-piece paperboard material, and which includes along the opposite sides thereof, internally of the carton, cushion flaps which are effective to frictionally engage the array of rectangular boxes being held by the carton in order to maintain the boxes in place while on display.

Further objects and advantages of the invention will become apparent from a reading of the following detailed description taken in conjunction with the drawings in which.

Figure 1:
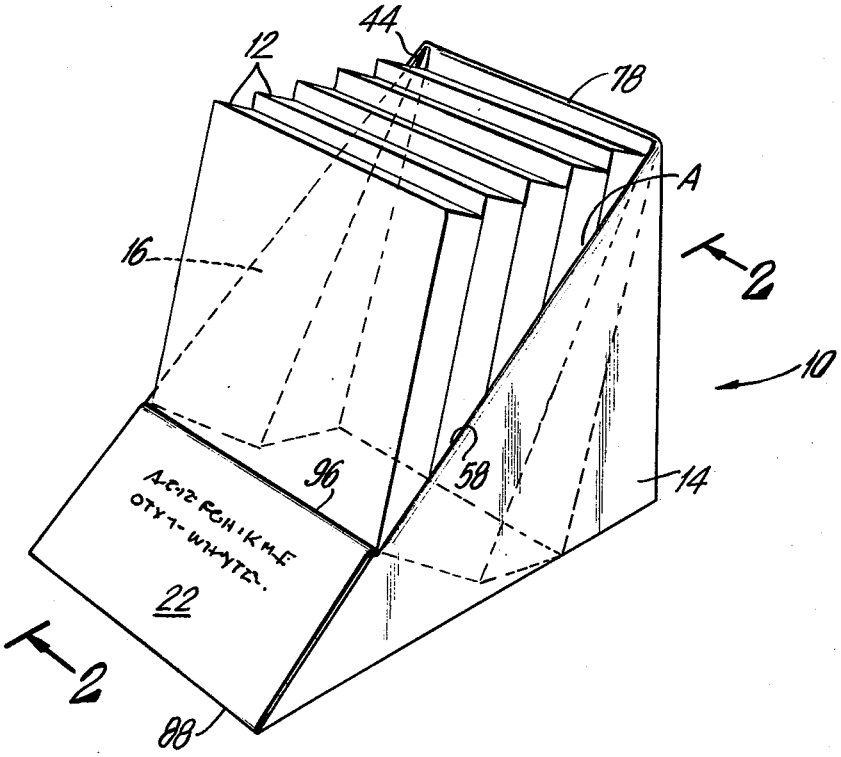
FIG. 1 is a perspective view of the subject carton for holding and displaying a stacked array of generally flat rectangular boxes disposed at an inclined angle to the vertical.
Figure 2:
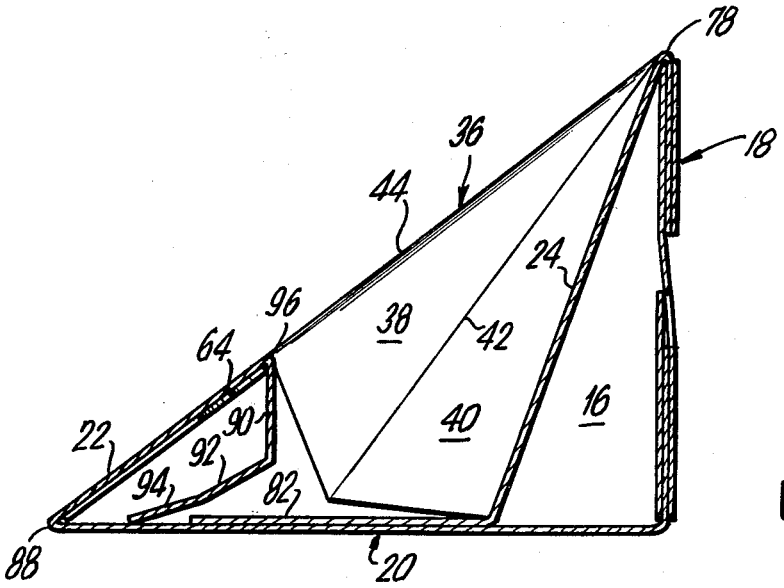
FIG. 2 is a sectional view taken along lines 2—2 in FIG. 1.

Referring to FIGS. 1 and 2, the carton according to the subject invention is designated by the numeral 10, and is of generally triangular configuration having an opening in the top portion thereof for accommodating a stacked array of boxes, designated by the numeral 12. Preferably, each box 12 is of generally flat rectangular configuration and is designed such that its width substantially corresponds to the width of the carton 10. The latter includes opposed side walls 14 and 16 which are of generally right triangular configuration, a back panel 18, and a bottom panel 20. The opposite side walls 14 and 16, and the upper edge of the back panel 18 define three sides of the central opening A which receives the boxes 12. The fourth edge of the opening A is defined by an indicia panel 22 which partially extends along the longer side of the triangular sides 14 and 16. Disposed wholly within the carton 10 is an interior inclined wall 24 that extends from the upper edge of the back panel 18 to a point intermediate the length of the bottom panel 20. The inclined wall 24 provides a support and guide for the inclined disposition of the boxes 12 relative to the vertical axis.

Figure 3:
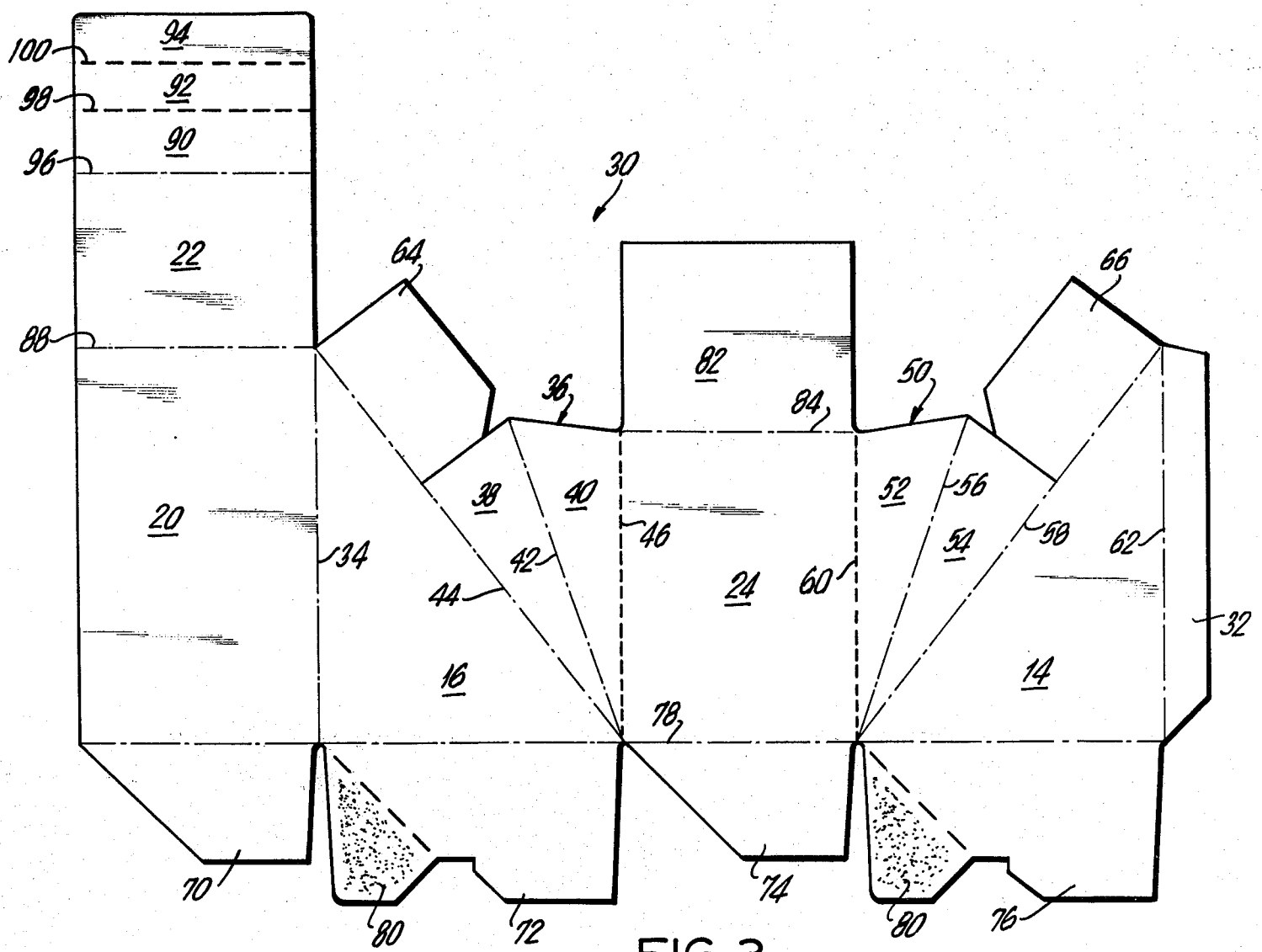
FIG. 3 is a plan view of a one-piece paperboard blank according to the subject invention.

Referring to FIG. 3, the blank of the subject invention which may be assembled into the carton 10 is generally designated by the numeral 30 and is preferably made of a one-piece paperboard material. Blank 30 comprises consecutively articulated base 20, side wall panel 16, interior inclined wall panel 24, side wall panel 14, and a manufacturer's glue flap 32. The base 20 is hingedly connected to the side wall 16 along hinge line 34, while side wall 16 is hingedly connected to the interior inclined wall 24 through an articulated cushion flap designated by the numeral 36. The cushion flap 36 is generally triangular in configuration and is formed of two segments, 38 and 40 which are also of triangular configuration, and which are hingedly connected along fold line 42. The cushion flap 36 is hingedly connected to the side wall 16 along hinge line 44, and to the interior inclined wall 24 along hinge line 46.

Likewise, side wall 14 is hingedly connected to the interior inclined wall 24 through an articulated cushion flap 50 formed of two triangular segments 52 and 54 hingedly connected along fold line 56. The side wall 14 is connected to the cushion flap 50 along fold line 58, and the cushion flap 50 is hingedly connected to the interior inclined wall 24 along fold line 60. The manufacturer's glue flap 32 is hingedly connected to the side wall 14 along hinge line 62. Also hingedly connected to the side wall 16 along hinge line 44 is an inclined wall support flap 64. A second inclined wall support flap 66 is hingedly connected to the side wall 14 along hinge line 58.

The back panel 18 of the erected carton 10 is formed by four interengaging flaps, designated by the numerals 70 through 76 which are hingedly connected along a common hinge line 78 to the base 20, side wall 16, interior inclined wall 24, and side wall 14 respectively. Adhesive 80 is applied to the back flaps 72 and 76. At the opposite end of the interior inclined wall 24 an interior horizontal base portion 82 is hingedly connected along hinge line 84.

An inclined front indicia wall 22 is hingedly connected to the base 20 along hinge line 88, and, in turn, hingedly connected to the wall 22 are three flap portions 90, 92, and 94 which are articulated along hinge lines 96, 98, and 100. Adhesive is also applied to the back surface (not shown) of the manufacturer's glue flap, and in the erected condition of the carton, the manufacturer's glue flap 32 is wholly disposed within the carton 10, and adhesively bonded to the base 20.

Turning to FIGS. 1 and 2, in the erected condition of the carton, the back panel is formed by the interengaging and bonding of the flaps 70 through 76 inclusive, and the interior inclined wall 24 is wholly disposed within the carton 10, with the horizontal base portion 82 being contiguous with the bottom panel 20. The manufacturer's glue flap 32 is bonded to the bottom panel 20, and the cushion flaps 36 and 50 are disposed within carton 10 respectively contiguous to the side walls 16 and 14. The inclined front indicia wall 22 overlaps the inclined wall support flaps 64 and 66, with the tuck-in flaps 90, 92, and 94 being folded, as shown in FIG. 2, beneath the front indicia wall 22. The resulting carton construction readily facilitates the acceptance of a stacked array of flat rectangular boxes 12 which are received within the opening A in the inclined top portion of the carton 10, as shown in FIG. 1. It is noted that the inclined top portion of the carton 10 forms an acute angle with respect to the bottom panel 20. Furthermore, by virtue of the two part articulated construction of each cushion flap 36, 50, as well as the fact that each cushion flap is connected along its opposite sides (44–46 and 58–60), each cushion flap forms a structure for maintaining the boxes 12 in position within the carton 10. In addition, it is noted that the peripheral edge of the open top portion of the carton 10 is defined by fold lines 44, 58, 78, and 96, wherein the entire peripheral portion of the opening 20 is formed by rounded corners, thereby resulting in an aesthetically pleasing carton, as well as a carton which does not include sharp edges along the peripheral opening into which the boxes 12 are disposed.

In summary, there is provided a new and improved carton for displaying and holding a plurality of articles, such as flat generally rectangular boxes in an aesthetically pleasing manner and in the manner which enables good visability of the product at the point of purchase, as well as multi-stacking of the boxes. As visability of the product is afforded from both the front and top, as well as the sides, of the boxes 12, and because of the arrangement of the internal cushion flaps within the carton, suspension and resilient gripping of the boxes is achieved, and the boxes 12 are maintained in a fixed position through frictional contact of the opposed inwardly directed cushion flaps. Still further, the disposition of the various elements of the subject carton acts to reinforce the resulting erected structure of the carton. The erected carton also provides an aesthetically pleasing construction, and the opening through which the rectangular boxes are accepted is peripherally defined by fold lines, thereby further enhancing the aesthetics of the carton. The internal inclined surface 24 aids in properly orienting the boxes 12 within the carrier carton 10 to the desired angle for display purposes.

While the carton and blank herein disclosed form preferred embodiments of this invention, this invention is not limited to those specific embodiments, and changes can be made therein without departing from the scope of this invention which is defined in the appended claims.

What is claimed is:

1. A carton for holding and displaying a stacked array of generally flat rectangular boxes disposed at an inclined angle to the vertical, said carton comprising:

a base;

first and second upstanding side panels, each of said side panels being hingedly connected to said base, said side panels being substantially triangular in configuration;

first and second pairs of cushion flaps, each of said pairs of cushion flaps being hingedly connected to one of said side panels, each of said cushion flaps being substantially triangular in configuration;

a composite rear panel formed of four interengaging flaps respectively connected to said side panels and said base;

an interior inclined wall member hingedly connected at its top edge to the top edge of said composite rear panel, each of the opposite side edges of said interior wall member being hingedly connected to one of said pairs of cushion flaps;

a base support member hingedly connected to the lower edge of said inclined wall member and disposed flush against said base;

first and second side support members, each of said side support members being hingedly connected to one of said side panels, and extending from its respective side panel toward the opposite side panel;

an inclined indicia panel hingedly connected to said base and disposed one the top surfaces of said side support panels; and a plurality of locking flaps hingedly connected in succession to said inclined indicia panel, said locking flaps being disposed on the lower surface of said side support members.

2. A carton as defined in claim 1 wherein each said side panel is in the shape of a right triangle.

3. A carton as defined in claim 1 made of a one-piece paperboard material.

4. A carton as defined in claim 1 wherein the inclined support panel extends at an acute angle with respect to the generally vertical back panel of the carton.

5. A carton as defined in claim 1 in which each of the cushion flaps is substantially right triangular in configuration.

6. A one piece paperboard blank for erecting a carton for holding and displaying a stacked array of generally rectangular boxes disposed at an acute angle to the vertical, said blank comprising a first side wall, said side wall being substantially right triangular in configuration; a manufacturers glue flap hingedly connected to a lateral edge of said first side wall; a first rear flap hingedly connected to the bottom edge of said first side wall; a first pair of cushion flaps hingedly connected along a portion of the hypotenuse of said first side wall; a first side support flap hingedly connected to the remaining portion of the hypotenuse of said first side wall; an inclined interior panel hingedly connected along one edge thereof to said first pair of cushion flaps; a second rear flap hingedly connected to the lower edge of said inclined interior panel; a base support member hingedly connected to the top edge of said inclined interior panel; a second pair of cushion flaps hingedly connected to the other lateral side edge of said interior inclined panel; a second side wall, said second side wall being substantially right triangular in configuration, a portion of the hypotenuse of said second side wall being hingedly connected to said second pair of cushion flaps; a second side support member hingedly connected to the remaining portion of the hypotenuse of said second side wall; a third rear flap hingedly connected to the lower edge of said second side wall; a base panel hingedly connected to a lateral edge of said second side wall; a fourth rear flap hingedly connected to the lower edge of said base panel; an indicia panel hingedly connected to the top portion of said base panel; and a plurality of locking flap members hingedly connected in succession to the top edge of said indicia panel.

* * * * *